US006348443B1

(12) United States Patent
Hanada et al.

(10) Patent No.: US 6,348,443 B1
(45) Date of Patent: Feb. 19, 2002

(54) SOLVENT COMPOSITION

(75) Inventors: Tsuyoshi Hanada; Masaaki Tsuzaki, both of Ichihara (JP)

(73) Assignee: Asahi Glass Company, Limited, Tokyo (JP)

( * ) Notice: Subject to any disclaimer, the term of this patent is extended or adjusted under 35 U.S.C. 154(b) by 0 days.

(21) Appl. No.: 09/716,302

(22) Filed: Nov. 21, 2000

(30) Foreign Application Priority Data

Nov. 25, 1999 (JP) ..... 11-334830

(51) Int. Cl.[7] ..... C11D 3/44; C11D 3/24; C11D 7/28

(52) U.S. Cl. ..... 510/407; 510/175; 510/285; 510/411; 510/412; 510/506; 252/364

(58) Field of Search ..... 252/364, 67; 510/411, 510/412, 410, 291, 175, 407, 285, 506; 134/42; 106/311

(56) References Cited

U.S. PATENT DOCUMENTS 5,827,812 A * 10/1998 Flyn et al.
5,989,456 A 11/1999 Tsuzaki

FOREIGN PATENT DOCUMENTS

JP 411035991 A * 2/1999

* cited by examiner

*Primary Examiner*—Yogendra N. Gupta
*Assistant Examiner*—Gregory E. Webb
(74) *Attorney, Agent, or Firm*—Oblon, Spivak, McClelland, Maier & Neustadt, P.C.

(57) ABSTRACT

A solvent composition comprising dichloropentafluoropropane, perfluorobutyl methyl ether and an alcohol.

5 Claims, No Drawings

SOLVENT COMPOSITION

BACKGROUND OF THE INVENTION

1. Field of the Invention

The present invention relates to a solvent composition comprising dichloropentafluoropropane, perfluorobutyl methyl ether and an alcohol. The composition of the present invention is useful as a cleaning agent for e.g. degreasing or defluxing, or as a dewatering solvent.

2. Discussion of Background

Heretofore, dichloropentafluoropropane (hereinafter referred to simply as R225) which is non-flammable and has high chemical stability and thermal stability, a mixed solvent having an alcohol or a hydrocarbon added to R225, or a cleaning agent made of perfluorobutyl methyl ether, has been used for e.g. degreasing, defluxing or particle removal of precision machinery components, electronic components, printed circuit boards mounting such components, optical components, etc.

Further, a method of employing a mixed solvent having an alcohol added to R225 has been proposed for dewatering (the dewatering means a method for removing water by dipping an article wetted with water in a solvent to let the attached water float and withdrawing the article after removing the floating water).

However, R225 or a cleaning agent having an alcohol or a hydrocarbon added to R225 has had a problem of resenting an adverse effect such as cracking, whitening or crazing to some synthetic resins or rubber materials, such as acrylics, ABS resins or polycarbonate resins. Further, perfluorobutyl methyl ether has had a problem that the solvency for oils is small, whereby no adequate cleaning can be accomplished. As a solvent to solve such problems, a mixed solvent having the solvency for oils improved by adding R225 to perfluorobutyl methyl ether (JP-A-10-510579, JP-A-11-357991) or a mixed solvent having an alcohol added to perfluorobutyl methyl ether, has been proposed.

However, the mixed solvent of JP-A-10-510579 has had a problem that the content of R225 is high, and the adverse effect to acrylics, etc., can not be overcome. Further, with the mixed solvent of JP-A-11-357991, the adverse effect to e.g. acrylics can be suppressed by lowering the content of R225, but there is a problem that the solvency for oils tends to be low. When such a mixed solvent is used as a cleaning solvent, there has been a problem that the application is limited to particle removal or to cleaning of an article having a relatively small amount of oils attached thereto.

The mixed solvent having an alcohol added to perfluorobutyl methyl ether, has had a problem that it is difficult to handle since if it is formulated to have a composition which is capable of sufficiently dissolving oils, such will be a composition having a flash point, or a problem from the viewpoint of the working environment.

SUMMARY OF THE INVENTION

The present inventors have found that a solvent composition having an alcohol incorporated to a composition comprising R225 and perfluorobutyl methyl ether as essential components, is capable of cleaning not only a material which can be cleaned by R225 but also an acrylics, an ABS resin, a polycarbonate resin, etc. Further, it has been found that such a composition can be a solvent composition having a good solvency for oils and being excellent in general-purpose properties and capable of sufficient dewatering, etc.

Namely, the present invention provides a solvent composition comprising R225, perfluorobutyl methyl ether and an alcohol.

DETAILED DESCRIPTION OF THE PREFERRED EMBODIMENTS

In the present invention, R225 means one or more dichloropentafluoropropanes represented by the molecular formula $C_3HCl_2F_5$. R225 is preferably at least one member selected from the group consisting of 3,3-dichloro-1,1,1,2,2-pentafluoropropane (hereinafter referred to simply as R225ca) and 1,3-dichloro-1,1,2,2,3-pentafluoropropane (hereinafter referred to simply as R225cb). When R225 comprises R225ca and R225cb, the respective proportions are not particularly limited. For example, when the proportions are represented by a mass ratio, one having a ratio of R225ca/R225cb=1 to 99/1 to 99 is preferred, and one having a ratio of R225ca/R225cb=40 to 50/50 to 60 is particularly preferred.

In the present invention, the perfluorobutyl methyl ether is at least one member selected from a group of compounds represented by the molecular formula $C_4F_9$—O—$CH_3$. The perfluorobutyl methyl ether is preferably perfluoro-n-butyl methyl ether and/or perfluoroisobutyl methyl ether.

When the perfluorobutyl methyl ether comprises perfluoro-n-butyl methyl ether and perfluoroisobutyl methyl ether, the respective proportions are not particularly limited. For example, the proportions (mass ratio) are preferably perfluoro-n-butyl methyl ether/perfluoroisobutyl methyl ether=10 to 80/20 to 90. Particularly preferred is perfluoro-n-butyl methyl ether/perfluoroisobutyl methyl ether=20 to 60/40 to 80.

Further, the mass ratio of R225 and the perfluorobutyl methyl ether is preferably such that R225 is from 10 to 50 mass %, and the perfluorobutyl methyl ether is from 50 to 90 mass %, based on the total amount of R225 and the perfluorobutyl methyl ether, whereby the adverse effect to an acrylics will be remarkably small.

The alcohol in the present invention is preferably selected from known alcohol and particularly preferably at least one member selected from the group consisting of methanol, ethanol and 2-propanol.

The amount of the alcohol is not particularly limited. However, the alcohol is preferably from 0.1 to 15 mass %, particularly preferably from 2 to 15 mass %, based on the total amount of R225 and the perfluorobutyl methyl ether, whereby the composition becomes non-flammable, and the solvency for oils, and the dewatering performance, will be improved.

Further, it is particularly preferred that the total amount of R225 and the perfluorobutyl methyl ether is from 85 to 98 mass %, and the amount of the alcohol is from 2 to 15 mass %, based on the total amount of R225, the perfluorobutyl methyl ether and alcohol.

With the composition of the present invention, it is particularly preferred to specify the type and the amount of the alcohol in the composition, since change in the concentration of the alcohol can be prevented. For example, when the amount of the alcohol is represented by mass %, based on the total amount of R225, the perfluorobutyl methyl ether and the alcohol, if the alcohol is methanol, the amount is preferably from 6 to 8 mass %, particularly preferably 7.2 mass %. If the alcohol is ethanol, the amount is preferably from 4 to 6 mass %, particularly preferably 5.2 mass %. If the alcohol is 2-propanol, the amount is preferably from 3.5 to 5.5 mass %, particularly preferably 4.4 mass %. The solvent composition wherein the compositional change in the concentration of the alcohol is small, has an advantage that it can be used for vapor degreasing, and it can maintain a stabilized solvent performance even when used for vapor degreasing.

The composition of the present invention may contain other components in addition to R225, the perfluorobutyl methyl ether and the alcohol. Usually, it is preferred that it is composed solely of the essential three components. As other component, a stabilizer may, for example, be mentioned.

The solvent composition of the present invention presents little adverse effect to materials, such as plastics such as acrylics, plasticized vinyl chloride resins, polycarbonate resins or ABS resins, or rubbers such as nitrile rubber. Accordingly, it is useful for e.g. cleaning of one of these materials, a composite material having at least two such materials combined, or various articles employing such materials or composite materials.

The composition of the present invention is preferably used as a cleaning agent. When used as a cleaning agent, it can be used specifically as a solvent for cleaning oils deposited on various articles made of glass, ceramics, plastics, rubbers or metals (such as degreasing), for cleaning to remove flux, ink or particle, or for dry cleaning. It is particularly preferred to use the composition of the present invention as a cleaning agent or a particle remover for e.g. IC components, electrical instruments, precision machinery or optical lenses. As the cleaning method, hand wiping, dipping, spraying, ultrasonic cleaning, vapor degreasing or a combination thereof may be employed. Further, the solvent composition of the present invention can be used for dewatering of e.g. lenses, liquid crystal display device components, electronic components, precision machinery components, resin molded products, etc.

Now, the present invention will be described in further detail with reference to Examples. However, it should be understood that the present invention is by no means restricted to such specific Examples.

Hereinafter, R225ca will be referred to as ca, R225cb as cb, the perfluoro-n-butyl methyl ether as nB, and the perfluoroisobutyl methyl ether as iB. Examples 1 to 7 and 13 to 21 are Examples of the present invention, and Examples 8 to 12 are Comparative Examples.

EXAMPLES 1 TO 12

A solvent composition having a composition as identified in Table 1 was prepared. In the column for alcohol in Table 1, A is composed of methanol, B ethanol, C 2-propanol, and D a mixture of methanol and ethanol in a ratio of 85:15 (mass ratio). Using such solvent composition, the following evaluations were carried out.

(1) Evaluation of solubility of oils

Oil (DufnicutAS-40H, tradename, manufactured by Idemitsu Kosan K.K.) were put in the solvent composition, whereby the dissolved amount was obtained. Evaluation was made using as a reference the mass of DufnicutAS-40H dissolved in Example 8. Evaluation standards for the solubility of oils were such that relative to the amount of oils dissolved in Example 8, symbol ⊙ indicates an amount exceeding 1.1 times, symbol Δ indicates an amount of from 0.9 to 1.1 times, and symbol X indicates an amount of less than 0.9 time. The results are shown in Table 1.

(2) Evaluation of the removability of water

A glass sheet of 30 mm×1 mm×5 mm was immersed in pure water, then immersed in the solvent composition is for 20 seconds for dewatering, and withdrawn. The glass sheet was then immersed in dry methanol. The difference in concentration of the moisture contained in methanol before and after the immersion was measured, and the amount of attached water was determined from the difference. The determination standards were such that symbol ⊙ indicates that no attached water remains, symbol Δ indicates that attached water remains a little, and symbol X indicates that attached water remains in a large amount. The results are shown in Table 1.

(3) Change of acrylics

A test coupon (25 mm×30 mm×3 mm) of an acrylics was immersed at room temperature for 5 minutes. The test coupon after the immersion was visually observed, and the appearance change was evaluated (⊙: no change, X: cracking, whitening or crazing formed). The results are shown in Table 1.

(4) Measurement of flash point

Presence or absence of a flash point was measured by means of a Cleveland open-cup flash point tester. The results are shown in Table 1.

TABLE 1

| Example | ca | cb | nB | iB | Alcohol | Solubility of oils | Removability of water | Change of acrylics | Flash point |
|---|---|---|---|---|---|---|---|---|---|
| 1 | 3.4 | 5.1 | 45.9 | 30.6 | A: 15.0 | ⊙ | ⊙ | ⊙ | Absent |
| 2 | 12.1 | 14.9 | 25.2 | 37.8 | B: 10.0 | ⊙ | ⊙ | ⊙ | Absent |
| 3 | 23.8 | 23.8 | 9.4 | 38.0 | C: 5.0 | ⊙ | ⊙ | ⊙ | Absent |
| 4 | 24.5 | 24.5 | 9.8 | 39.2 | A: 2.0 | ⊙ | ⊙ | ⊙ | Absent |
| 5 | 13.2 | 16.2 | 27.4 | 41.2 | B: 2.0 | ⊙ | ⊙ | ⊙ | Absent |
| 6 | 3.9 | 5.9 | 52.9 | 35.3 | C: 2.0 | ⊙ | ⊙ | ⊙ | Absent |
| 7 | 0 | 9.8 | 44.1 | 44.1 | D: 2.0 | ⊙ | ⊙ | ⊙ | Absent |
| 8 | 36.0 | 44.0 | 10.0 | 10.0 | 0 | — | × | × | Absent |
| 9 | 10.0 | 10.0 | 40.0 | 40.0 | 0 | × | × | ⊙ | Absent |
| 10 | 50.0 | 50.0 | 0 | 0 | 0 | ⊙ | × | × | Absent |
| 11 | 47.5 | 47.5 | 0 | 0 | B: 5.0 | ⊙ | ⊙ | × | Absent |
| 12 | 0 | 0 | 42.5 | 42.5 | C: 15.0 | ⊙ | ⊙ | ⊙ | Present |

EXAMPLES 13 TO 21

Referring to Table 2, 1,000 g of a solvent composition having a composition as shown in the line for "Before distillation", was put into a distillation flask. Using a fractionating column having a theoretical plate number of 5 plates, distillation was carried out under atmospheric pressure for 6 hours, whereby 100 g of fractions were collected. The composition of the solvent composition sampled before or after the distillation was measured by gas chromatography, and the results are shown in Table 2. The alcohol in Example 13, 14 or 19 was methanol, the alcohol in Example 15, 16 or 20 was ethanol, and the alcohol in Example 17, 18 or 21 was 2-propanol.

TABLE 2

| Ex. | | Composition (mass %) | | | | |
|---|---|---|---|---|---|---|
| | | ca | cb | nB | iB | Alochol |
| 13 | Before distillation | 11.3 | 16.9 | 39.5 | 26.3 | 6.0 |
| | After distillation | 10.5 | 16.4 | 39.9 | 27.0 | 6.2 |
| 14 | Before distillation | 23.0 | 23.0 | 9.2 | 36.8 | 8.0 |
| | After distillation | 22.1 | 22.4 | 9.9 | 37.3 | 8.3 |
| 15 | Before distillation | 24.0 | 24.0 | 9.6 | 38.4 | 4.0 |
| | After distillation | 23.2 | 23.4 | 10.2 | 39.1 | 4.1 |
| 16 | Before distillation | 4.2 | 5.2 | 33.8 | 50.8 | 6.0 |
| | After distillation | 3.8 | 4.9 | 34.2 | 50.9 | 6.2 |
| 17 | Before distillation | 4.3 | 5.3 | 34.7 | 52.2 | 3.5 |
| | After distillation | 3.7 | 4.9 | 35.1 | 52.7 | 3.6 |
| 18 | Before distillation | 11.3 | 17.0 | 39.7 | 26.5 | 5.5 |
| | After distillation | 11.7 | 16.5 | 40.1 | 26.1 | 5.6 |
| 19 | Before distillation | 4.2 | 5.1 | 33.4 | 50.1 | 7.2 |
| | After distillation | 3.8 | 4.8 | 33.7 | 50.5 | 7.2 |
| 20 | Before distillation | 11.4 | 17.1 | 39.8 | 26.5 | 5.2 |
| | After distillation | 11.0 | 16.8 | 40.1 | 26.9 | 5.2 |
| 21 | Before distillation | 23.9 | 23.9 | 9.6 | 38.2 | 4.4 |
| | After distillation | 23.5 | 23.7 | 9.8 | 38.6 | 4.4 |

The solvent composition of the present invention presents no adverse effect to resins, and thus it is a solvent composition excellent in general-purpose properties, which can be used for e.g. cleaning various articles made of various materials including an acrylics and made of a composite material comprising two or more such materials.

The composition has a good solvency for oils and is also excellent performance of dewatering, and such performances will be provided even by a composition having no flash point. Accordingly, when cleaning is carried out by means of such a composition, adequate cleaning effects will be provided even in cleaning of oils or in dewatering.

Further, by adjusting the amount of the alcohol to a certain level, a stable composition will be obtained whereby change in the solvent composition is little, and an extremely stabilized solvent performance can be maintained even when the composition is used for e.g. vapor degreasing.

The entire disclosure of Japanese Patent Application No. 11-334830 filed on Nov. 25, 2000 including specification, claims and summary are incorporated herein by reference in its entirety.

What is claimed is:

1. A solvent composition comprising:

dichloropentafluoropropane, perfluorobutyl methyl ester and an alcohol, wherein the dichloropentafluoropropane is from 10 to 50 mass % and the perfluorobutyl methyl ether is from 50 to 90 mass %, based on the total amount of the dichloropentafluoropropane and the perfluorobutyl methyl ether, and wherein the total amount of the dichloropentafluoropropane and the perfluorobutyl methyl ether is from 85 to 98 mass % and the alcohol is from 2 to 15 mass %, based on the total amount of the dichloropentafluoropropane, the perfluorobutyl methyl ether and the alcohol.

2. The solvent composition according to claim 1, wherein the dichloropentafluoropropane is 3,3-dichloro-1,1,1,2,2-pentafluoropropane and/or 1,3-dichloro-1,1,2,2,3-pentafluoropropane.

3. The solvent composition according to claim 1, wherein the perfluorobutyl methyl ether is perfluoro-n-butyl methyl ether and/or perfluoroisobutyl methyl ether.

4. The solvent composition according to claim 1, wherein the alcohol is at least one member selected from the group consisting of methanol, ethanol and 2-propanol.

5. The solvent composition according to claim 1, wherein the alcohol is from 0.1 to 15 mass %, based on the total amount of the dichloropentafluoropropane, the perfluorobutyl methyl ether and the alcohol.

* * * * *